US009316021B2

(12) United States Patent
Burciaga et al.

(10) Patent No.: US 9,316,021 B2
(45) Date of Patent: Apr. 19, 2016

(54) STRIKER PLATE ASSEMBLY

(71) Applicants: Fernando Burciaga, Cd. Juárez (MX); Francisco Javier Lujan, Cd. Juárez (MX); Rodrigo Alonso Galindo, Cd. Juárez (MX)

(72) Inventors: Fernando Burciaga, Cd. Juárez (MX); Francisco Javier Lujan, Cd. Juárez (MX); Rodrigo Alonso Galindo, Cd. Juárez (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 238 days.

(21) Appl. No.: 13/858,541

(22) Filed: Apr. 8, 2013

(65) Prior Publication Data

US 2013/0285395 A1 Oct. 31, 2013

Related U.S. Application Data

(60) Provisional application No. 61/623,962, filed on Apr. 13, 2012.

(51) Int. Cl.

| | |
|---|---|
| ***E05B 15/02*** | (2006.01) |
| ***E05B 77/38*** | (2014.01) |
| ***E05B 85/04*** | (2014.01) |

(52) U.S. Cl.

CPC ..... *E05B 15/0295* (2013.01); *E05B 77/38* (2013.01); *E05B 85/045* (2013.01); *Y10T 292/68* (2015.04)

(58) Field of Classification Search

CPC ..... E05B 85/045; E05B 77/38; E05B 77/36; E05B 15/0006; E05B 15/0225; E05B 15/0295; Y10S 292/56; Y10S 292/73; E05C 3/24

USPC ..... 292/340, 341.12

See application file for complete search history.

(56) References Cited

U.S. PATENT DOCUMENTS

| | | | | |
|---|---|---|---|---|
| 7,029,043 | B2 * | 4/2006 | Fisher | 292/341.13 |
| 7,097,219 | B2 * | 8/2006 | Paskonis | 292/340 |
| 2002/0000727 | A1 * | 1/2002 | Rass et al. | 292/216 |

* cited by examiner

*Primary Examiner* — Mark Williams

(74) *Attorney, Agent, or Firm* — Cantor Colburn LLP

(57) ABSTRACT

A striker plate assembly for use with a latch includes a base plate having an angled first end and an angled second end. A generally u-shaped striker wire extends perpendicular to the base plate. A first sidewall and a second sidewall are connected to the first end and the second end of the base plate respectively. The first sidewall and the second sidewall extend generally perpendicular to the base plate in the same direction as the striker wire. The first sidewall and the second sidewall include a geometric feature. A first bumper is connected to the first sidewall through the geometric feature and a second bumper is connected to the second sidewall through the geometric feature.

18 Claims, 4 Drawing Sheets

STRIKER PLATE ASSEMBLY

This application claims the benefit of U.S. Provisional Patent Application No. 61/623,962 filed Apr. 13, 2012, the entire contents of which are incorporated herein by reference thereto.

TECHNICAL FIELD

Exemplary embodiments of the present invention relate generally to a latch mechanism and, more particularly, to a striker plate of a latch mechanism.

BACKGROUND

Latches have different packaging requirements for various applications such as lift gates, rear compartments, and decklids for example. Companies would like to promote new features of the latches used in their vehicles, such as improved sound quality and materials resistance for example. In addition to this desire to add new features, the space available for latch mechanisms continues to decrease. Because multiple latch mechanisms having various features exist for each type of vehicle, manufacturers would prefer a universal latch compatible with multiple vehicles. By standardizing the components of the latch, manufacturing and assembly costs will be reduced.

Accordingly, while existing vehicle latch mechanisms are suitable, the need for improvement remains, particularly in providing more compact and cost-effective latch mechanisms that may be used in multiple vehicles and can accommodate different features.

SUMMARY OF THE INVENTION

According to an exemplary embodiment of the present invention, a striker plate assembly for use with a latch is provided including a base plate having an angled first end and an angled second end. A generally u-shaped striker wire extends perpendicular to the base plate. A first sidewall and a second sidewall are connected to the first end and the second end of the base plate respectively. The first sidewall and the second sidewall extend generally perpendicular to the base plate in the same direction as the striker wire. The first sidewall and the second sidewall include a geometric feature. A first bumper is connected to the first sidewall through the geometric feature and a second bumper is connected to the second sidewall through the geometric feature.

According to another embodiment of the present invention, a latch assembly is provided including a striker plate assembly. The striker plate assembly includes a base plate having an angled first end and an angled second end. A generally u-shaped striker wire extends perpendicular to the base plate. A first sidewall and a second sidewall are connected to the first end and the second end of the base plate respectively. The first sidewall and the second sidewall extend generally perpendicular to the base plate in the same direction as the striker wire. The first sidewall and the second sidewall include a geometric feature. A first bumper is connected to the first sidewall through the geometric feature and a second bumper is connected to the second sidewall through the geometric feature. The latch additionally includes a latch housing having a slot for receiving the striker wire. When the latch and the striker plate assembly are engaged, a portion of the latch housing contacts the first bumper and the second bumper.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

Figure 1:
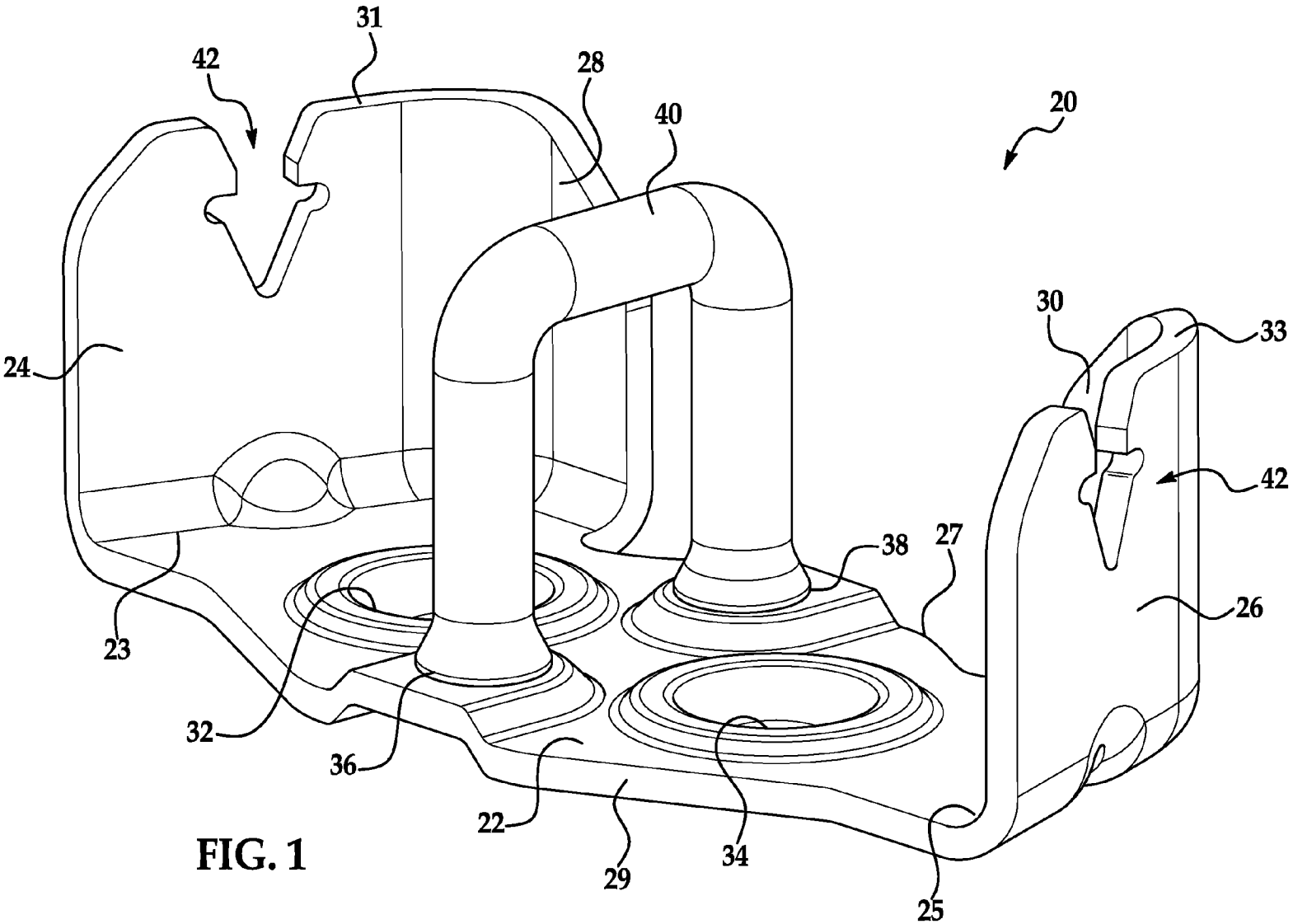
FIG. 1 is a perspective view of a striker plate assembly with the bumpers removed in accordance with an exemplary embodiment of the invention.

Referring now to FIG. 1, a striker plate assembly 20 for use with a latch is illustrated. This striker plate assembly 20 may be integrated into a component of a vehicle, such as a lift gate or trunk for example.

The striker plate assembly 20 includes a contoured base plate 22 having a plurality of generally centrally located holes 32, 34, 36, 38. In one embodiment, holes 32 and 34 are used to attach the striker plate assembly 20 to a vehicle component and a striker wire 40 is connected to the base plate 22 using holes 36 and 38. Exemplary fasteners for connecting the striker plate assembly 20 to a vehicle component include a countersunk screw, a bolt, and any other known fastening means. In one embodiment, holes 32 and 34 have the same diameter and are formed during a single manufacturing process, such as a punching operation for example. Similarly, striker wire holes 36 and 38 may have an equal diameter and may be created during a single manufacturing operation. As illustrated, the diameter of holes 32 and 34 may, but need not be, larger than the diameter of striker wire holes 36 and 38. The base plate 22 has a generally reduced thickness compared to conventional striker plates. In an exemplary embodiment, the thickness of the base plate 22 is about 2.6 mm. The portion of the base plate 22 surrounding the striker wire holes 36 and 38 may be out of the plane of the remainder of the base plate 22. In one embodiment, the portion of the base plate 22 surrounding the striker wire holes 36, 38 is raised. A generally U-shaped striker wire 40 is mounted to the base plate 22 at striker wire holes 36, 38. The striker wire 40 extends generally perpendicular to the side of the base plate 22 having holes 32, 34, 36, 38. In one embodiment, the striker wire 40 extends in the same direction that the portion of the base plate 22 surrounding the striker wire holes 36, 38 is raised.

A first sidewall 24 and a second sidewall 26 are attached at a first end 23 and a second, opposite end 25 of the base plate 22 respectively. The first end 23 and the second end 25 of the base plate 22 are angled such that a first side 27 of the base plate 22 is shorter than a second side 29 of the base plate 22. The sidewalls 24, 26 extend generally perpendicular to the planar surface of the base plate 22 in the same direction as the striker wire 40. In one embodiment, the sidewalls 24, 26 may be formed integrally with the base plate 22. Alternatively, the sidewalls 24, 26 may be attached to the base plate 22, such as by welding or brazing for example. A bent portion 28 of the first sidewall 24 extends from a corner of the first end 23 of the base plate 22 along a portion of the first side 27 of the base plate 22 toward the striker wire 40. The second sidewall 26 similarly has a bent portion 30 extending from a corner of the second end 25 along a portion of the first side 27 of the base plate 22 in the direction of the striker wire 40. In one embodiment, the bent portions 28, 30 are perpendicular to the plane of the striker wire 40.

Figure 2:
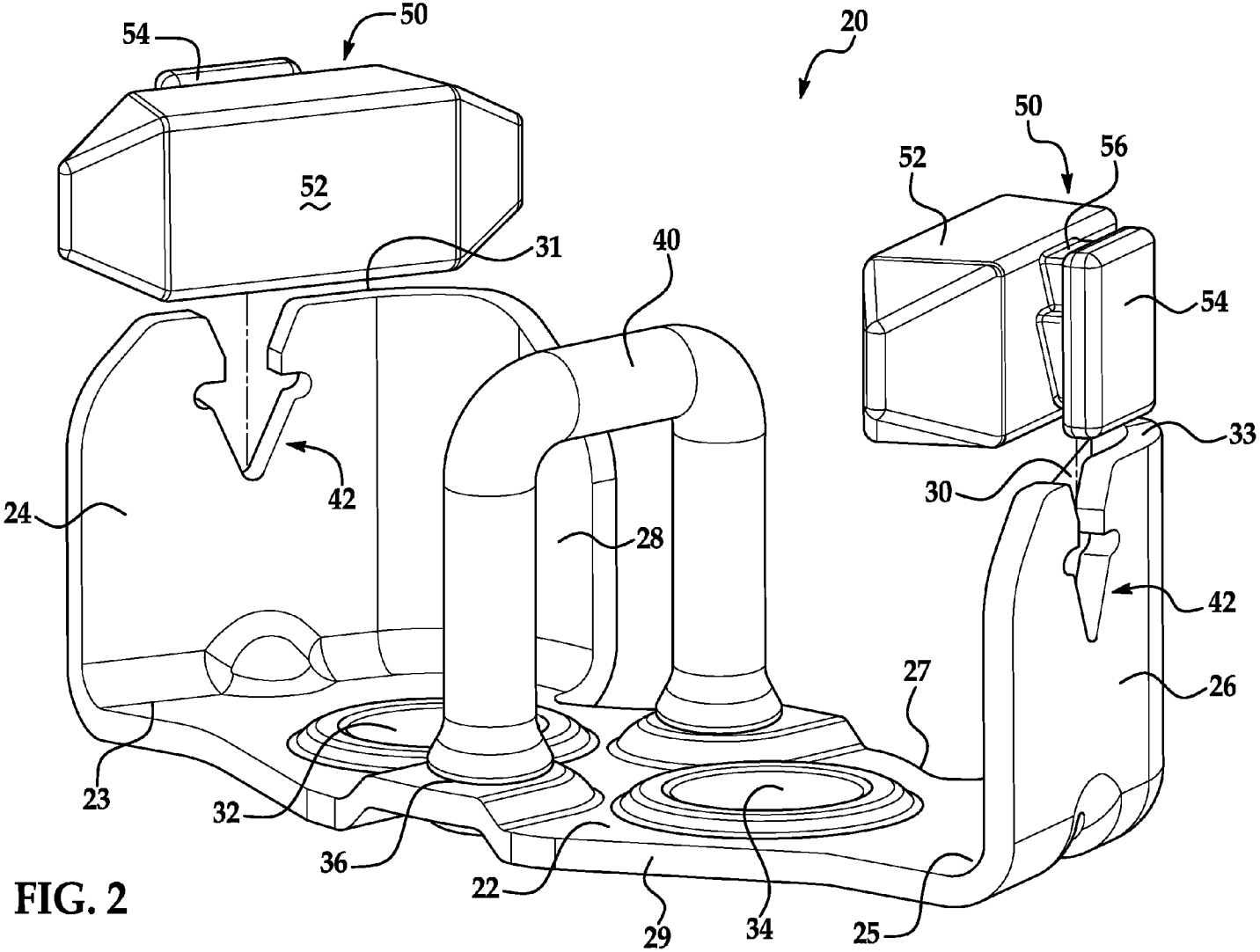
FIG. 2 is a perspective view of a striker plate assembly in accordance with an exemplary embodiment of the invention.

Centrally located about the top surface 31, 33 of each sidewall 24, 26 is a geometric feature 42, such as a slot for example, for retaining a bumper assembly 50 (see FIG. 2). In one embodiment, the geometric feature 42 includes a generally arrow-shaped slot, wherein the arrow is pointing in the direction of the base plate 22 and the leader of the arrow extends to the top surface 31, 33 of each sidewall 24, 26.

Referring now to FIG. 2, a bumper 50 includes a pad 52 attached to a retaining cap 54 by a connector 56. In one non-limiting embodiment, the bumper is constructed out of an elastomeric material capable of being compressed and adsorbing the shock of the latch as portions thereof enter into the striker plate assembly 20. Of course, numerous other types of materials are contemplated for the bumper 50. In one embodiment, a bumper 50 is connected to the first sidewall 24 and the second sidewall 26 of the striker plate assembly 20. The pad 52 of the bumper 50 may be positioned adjacent the surface of the sidewall 24, 26 closest to the striker wire 40 and the retaining cap 54 of the bumper 50 may be located adjacent the opposite side of the respective sidewall 24, 26 such that the connector 56 is located within the geometric feature 42 in the sidewall 24, 26. The connector 56 of the bumper 50 has a shape similar to the geometric feature 42. The contour of the geometric feature 42 allows the connector 56 to be easily located within the geometric feature 42 in a connected position, but inhibits the removal of the bumper 50 once connected. Though the illustrated connector 56 and geometric feature 42 are generally arrow-shaped, other shapes are considered within the scope of the invention. When connected to a sidewall 24, 26, the bumper 50 is positioned parallel to the sidewall 24, 26. In one embodiment, the first end 23 of the striker plate assembly 20 is the mirror image of the second end 25 of the strike plate assembly 20 across a center plane of the striker wire 40.

Figure 3:
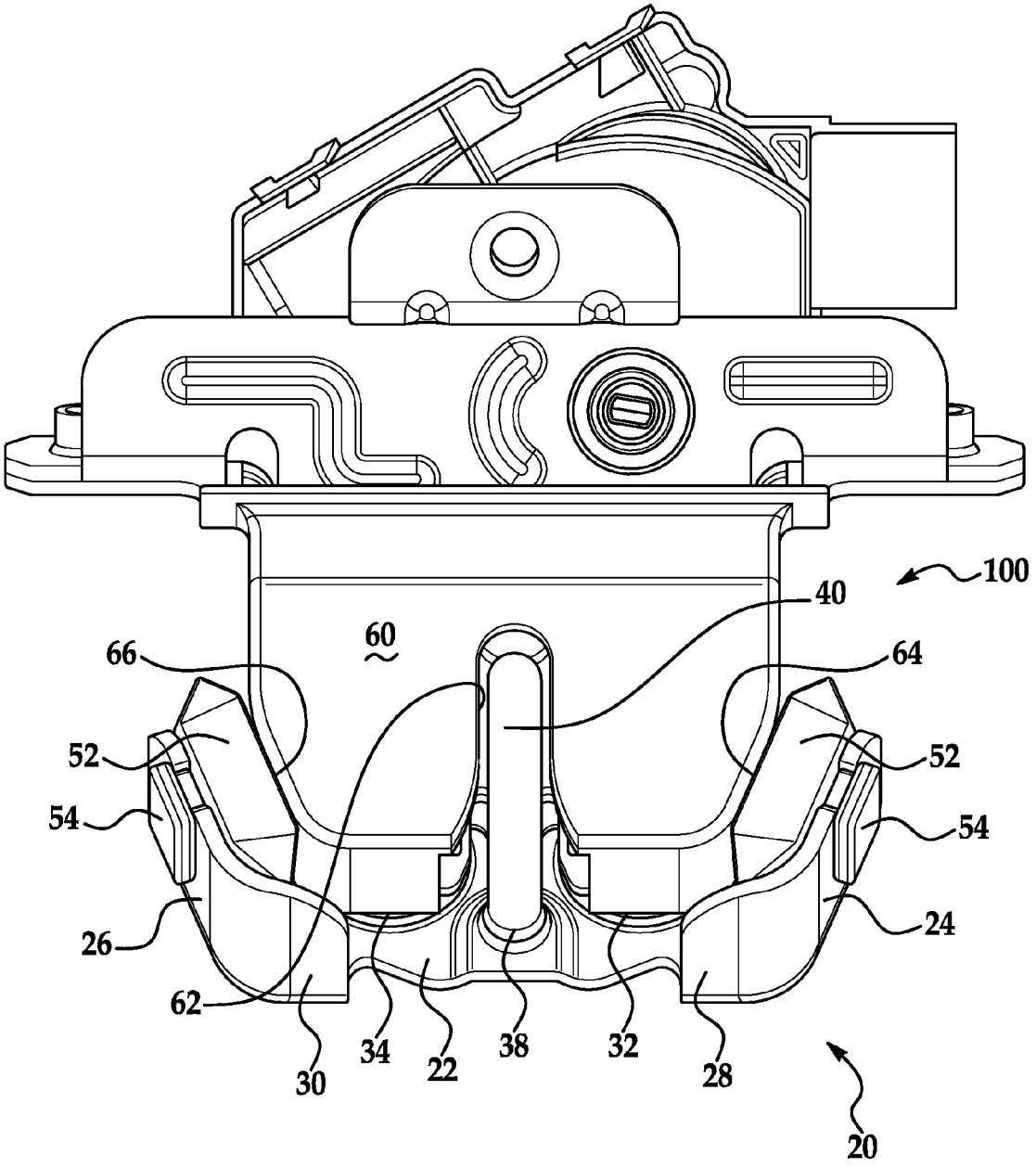
FIG. 3 is a front-perspective view of the interface between a striker plate assembly and a latch when the latch is engaged in accordance with an exemplary embodiment of the invention.
Figure 4:
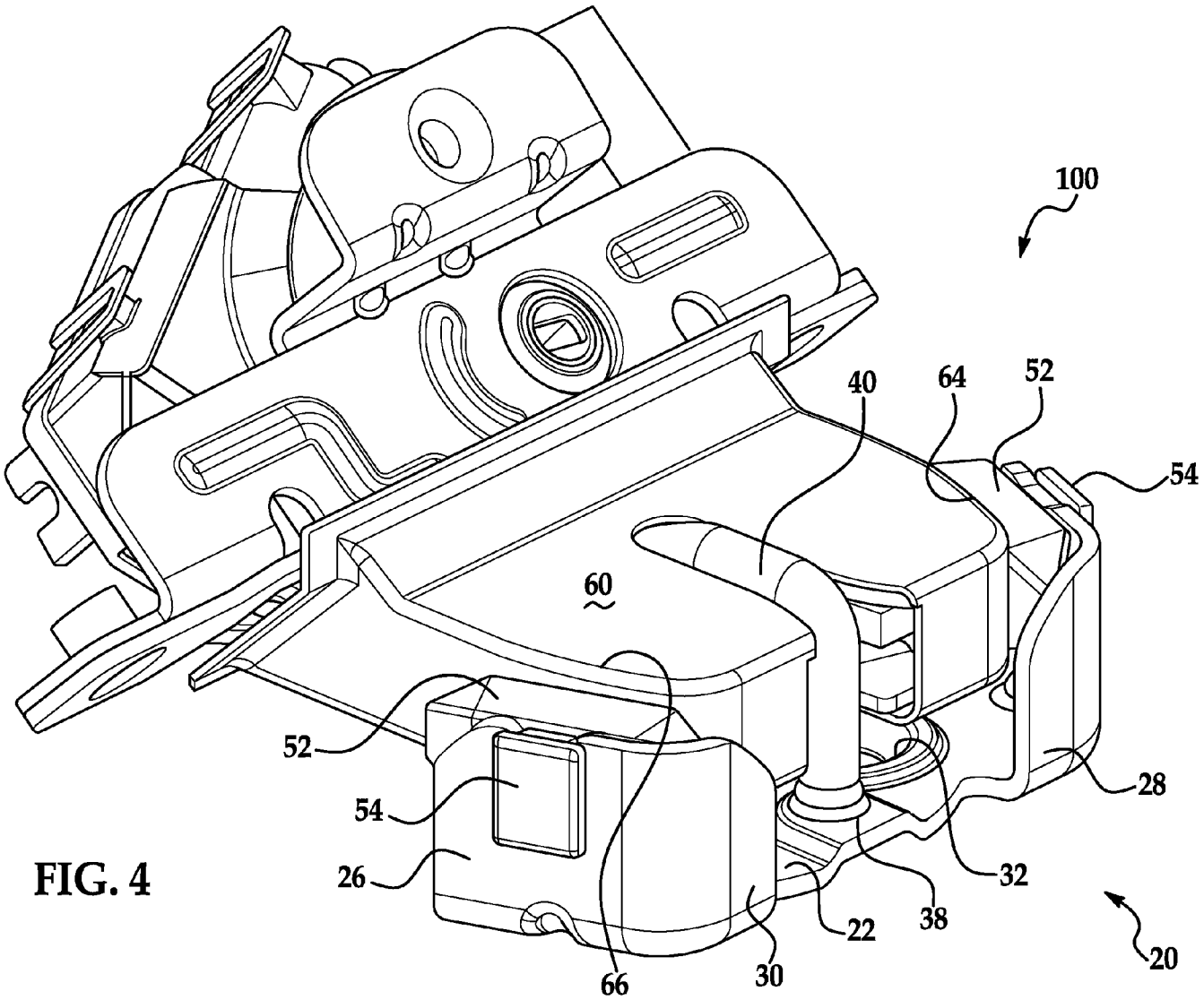
FIG. 4 is a side-perspective view of the interface between a striker plate assembly and a latch when the latch is engaged in accordance with an exemplary embodiment of the invention.

FIGS. 3 and 4 illustrate the interface between the striker plate assembly 20 and a latch 100 when the latch 100 is in an engaged position. The latch 100 may be integrated into a complementary vehicle component, such as the vehicle structure adjacent a lift gate or trunk for example. The latch 100 includes a latch housing 60 within which additional latch components (not shown), such as a fork bolt and detent for example, are located. The latch housing 60 includes a slot 62 for receiving the striker wire 40 of the striker plate assembly 20. When an exemplary lift gate is closed, the striker plate assembly 20 is moved into engagement with the latch 100, such that the striker wire 40 is located and retained within the slot 62 of the latch housing 60 and also within the throat of a corresponding rotatable fork bolt (not shown). When the striker plate assembly 20 is engaged with the latch 100, the sides 64, 66 of the latch housing 60 contact the bumpers 50 connected to the first sidewall 24 and the second sidewall 26 of the striker plate assembly 20. In one embodiment, the sides 64, 66 of the latch housing 60 are formed at angles generally similar to the first end 23 and the second end 25 of the base plate 22, such that the sides 64, 66 of the latch housing 60 are parallel to the pads 52 of the bumpers 50.

The size and complexity of the striker plate assembly 20 is reduced compared to convention latches. Because the manufacturing process and parts of the striker plate assembly 20 have been simplified, the overall cost is reduced. In addition, the bumpers 46 provide additional support to the latch 100 and improve the alignment between the striker plate assembly 20 and the latch 100. This improved alignment ultimately reduces the noise created when the striker plate assembly 20 is moved into engagement with the latch 100 and also prevents a rattle created by horizontal movement of the striker plate assembly 20 when engaged with the latch 100.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A striker plate assembly comprising:

a base plate having an angled first end and an angled second end;

a generally u-shaped striker wire extending generally perpendicular to the base plate;

a first sidewall connected at the first end of the base plate and a second sidewall connected at the second end of the base plate, wherein the first sidewall and the second sidewall extend generally perpendicular to the base plate in the same direction as the striker wire; wherein the first sidewall and the second sidewall include a geometric feature for receiving a bumper; and a first bumper connected to the first sidewall and a second bumper connected to the second sidewall, wherein the first sidewall and the second sidewall extend upwardly from opposite ends of the base plate and the u-shaped striker wire extends upwardly from a middle portion of the base plate located between the first sidewall and the second sidewall, wherein the first bumper extends toward the u-shaped striker wire from the first sidewall and the second bumper extends toward the u-shaped striker wire from the second sidewall.

2. The striker plate assembly according to claim 1, wherein the base plate has a thickness of about 2.6 mm.

3. The striker plate assembly according to claim 1, wherein the first bumper and the second bumper are identical.

4. The striker plate assembly according to claim 1, wherein the first end is a mirror image of the second end across a central plane of the striker wire.

5. A striker plate assembly comprising:

a base plate having an angled first end and an angled second end;

a generally u-shaped striker wire extending generally perpendicular to the base plate;

a first sidewall connected at the first end of the base plate and a second sidewall connected at the second end of the base plate, wherein the first sidewall and the second sidewall extend generally perpendicular to the base plate in the same direction as the striker wire; wherein the first sidewall and the second sidewall include a geometric feature for receiving a bumper; and a first bumper connected to the first sidewall and a second bumper connected to the second sidewall, wherein a pad of the first bumper is positioned adjacent the first sidewall between the first sidewall and the striker wire and a pad of the second bumper is positioned adjacent the second sidewall between the second sidewall and the striker wire.

6. A striker plate assembly comprising:

a base plate having an angled first end and an angled second end;

a generally u-shaped striker wire extending generally perpendicular to the base plate;

a first sidewall connected at the first end of the base plate and a second sidewall connected at the second end of the base plate, wherein the first sidewall and the second sidewall extend generally perpendicular to the base plate in the same direction as the striker wire; wherein the first sidewall and the second sidewall include a geometric feature for receiving a bumper; and a first bumper connected to the first sidewall and a second bumper connected to the second sidewall, wherein a first retaining cap is located adjacent the first sidewall opposite the pad of the first bumper and a second retaining cap is located adjacent the second sidewall opposite the pad of the second bumper, such that a first connector is located within the geometric feature of the first sidewall and a second connector is located within the geometric feature of the second sidewall.

7. The striker plate assembly according to claim 1, wherein the base plate includes at least one hole for fastening the striker plate assembly to a vehicle component.

8. The striker plate assembly according to claim 1, wherein a connector of the first bumper has a shape similar to the geometric feature.

9. The striker plate assembly according to claim 8, wherein the connector and the geometric feature are both generally arrow-shaped.

10. A latch assembly comprising:

a striker plate assembly including:

a base plate having an angled first end and an angled second end;

a generally u-shaped striker wire extending generally perpendicular to the base plate;

a first sidewall connected at the first end of the base plate and a second sidewall connected at the second end of the base plate, wherein the first sidewall and the second sidewall extend generally perpendicular to the base plate in the same direction as the striker wire; wherein each of the first sidewall and the second sidewall include a geometric feature;

a first bumper connected to the first sidewall and a second bumper connected to the second sidewall through the geometric feature; and a latch housing in which a plurality of latch components are located, the latch housing having a slot for receiving the striker wire, wherein when the latch and the striker plate assembly are engaged, a portion of the latch housing contacts the first bumper and the second bumper, wherein the first sidewall and the second sidewall extend upwardly from opposite ends of the base plate and the u-shaped striker wire extends upwardly from a middle portion of the base plate located between the first sidewall and the second sidewall, wherein the first bumper extends toward the u-shaped striker wire from the first sidewall and the second bumper extends toward the u-shaped striker wire from the second sidewall.

11. The latch assembly according to claim 10, wherein the base plate has a thickness of about 2.6 mm.

12. The latch assembly according to claim 10, wherein the first bumper and the second bumper are identical.

13. The latch assembly according to claim 10, wherein a first side of the latch housing contacts the first bumper and a second side of the latch housing contacts the second bumper.

14. The latch assembly according to claim 10, wherein an interface between the latch housing and the first bumper and second bumper locates the striker wire within the latch slot.

15. The latch assembly according to claim 14, wherein the interface between the latch housing and the first bumper and second bumper restricts movement of the striker wire within the latch slot.

16. The latch assembly according to claim 10, wherein the base plate includes at least one hole for fastening the striker plate assembly to a vehicle component.

17. The latch assembly according to claim 10, wherein a connector of the first bumper has a shape similar to the geometric feature.

18. The latch assembly according to claim 17, wherein the connector and the geometric feature are both generally arrow-shaped.

* * * * *